United States Patent [19]

De Byl

[11] Patent Number: 4,748,886

[45] Date of Patent: Jun. 7, 1988

[54] SOUND PICKUP ASSEMBLY FOR AN ACOUSTIC STRING INSTRUMENT AND INCLUDING A FOAM PAD ELEMENT SUPPORTING MICROPHONES

[76] Inventor: Franz De Byl, Nassauische Str., 1 Berlin 31, Fed. Rep. of Germany

[21] Appl. No.: 887,406

[22] PCT Filed: Oct. 21, 1985

[86] PCT No.: PCT/DE85/00407

§ 371 Date: Jun. 23, 1986

§ 102(e) Date: Jun. 23, 1986

[87] PCT Pub. No.: WO86/02765

PCT Pub. Date: May 9, 1986

[30] Foreign Application Priority Data

Oct. 22, 1984 [DE] Fed. Rep. of Germany ..... 8431266

[51] Int. Cl.[4] ..... G10H 3/18

[52] U.S. Cl. ..... 84/1.14; 84/1.16

[58] Field of Search ..... 84/1.14–1.16, 84/ DIG. 24

[56] References Cited

U.S. PATENT DOCUMENTS

| | | | |
|---|---|---|---|
| 2,680,986 | 6/1954 | Company . | |
| 3,085,460 | 4/1963 | Edwards | 84/1.16 X |
| 3,733,425 | 5/1973 | Chaki | 84/1.16 X |
| 4,242,938 | 1/1981 | Van Zalinge | 84/1.16 |
| 4,394,830 | 7/1983 | Damiano | 84/1.15 |

FOREIGN PATENT DOCUMENTS 2310066 9/1973 Fed. Rep. of Germany .

*Primary Examiner*—Stanley J. Witkowski

*Attorney, Agent, or Firm*—Wenderoth, Lind & Ponack

[57] ABSTRACT

A sound pickup assembly for an acoustic string instruments includes a pad element of foam material and shaped to be placed in an interference fit into a sound hole of the instrument. The foam pad element has therein openings for microphones and leads, with the microphones being positioned inside the foam pad element in a manner such that the sound waves inside the resonator body of the instrument may readily strike the surfaces of heads of the microphones without interference.

4 Claims, 2 Drawing Sheets

SOUND PICKUP ASSEMBLY FOR AN ACOUSTIC STRING INSTRUMENT AND INCLUDING A FOAM PAD ELEMENT SUPPORTING MICROPHONES

BACKGROUND OF THE INVENTION

The present invention relates to a pickup assembly including at least two microphones for acoustic string instruments, particularly for acoustic guitars.

Prior pickup devices of this kind usually include microphone holding means to be affixed to the external surface of the acoustic guitar. It has been known also to install microphones inside the resonator cavity of a guitar. For picking up sound, it is important to attenuate frequencies at the lower end of the medium range of audio frequencies. Without such attenuation the instrument's inherent resonance may peak to more than 30 db. High-sensitivity microphones are expensive and provide no satisfactory solution to the problem. Acoustic guitars having an inherent resonance near the lower end of the medium frequency range (about 150 to 300 Hz) are commercially available in a broad range of qualities.

SUMMARY OF THE INVENTION

The object underlying the present invention is to provide a sound pickup assembly of the aforesaid type which is suited for cost-effective large-scale production and is universally applicable to acoustic string instruments of virtually any tape, and particularly to all types of acoustic guitars, and which in particular provides for attenuation so as to linearize the frequency response. In addition, the pickup device of the present invention is intended to be easily and quickly manipulable. In accordance with the invention, this object is achieved by a pad of foam material which has guide openings extending therethrough for microphones and connecting leads, and which is adapted to be mounted inside the sound hole of the instrument with its outwardly directed end face extending flush with the resonator body of the instrument, with the microphones being adapted to be positioned inside the foam pad in a manner such that the sound waves inside the resonator body of the instrument may without interference strike the surface of each microphone head.

Advantageous further developments of the inventive pick-up assembly are recited in the dependent claims.

The inventive pickup assembly ensures excellent attentuation of the instrument's inherent resonance as the foam material acts to linearize the frequency response at the lower end of the medium frequency range. The foam pad may consist of any suitable damping material; however, it is preferred to use foamed plastics. The foam pad is designed to be manually inserted in position in an interference fit in the sound hole of the instrument and ensures positive placement of the microphone leads and secure retention of the microphones. In the inventive assembly, the microphones may be most simple in construction and quality without sacrificing frequency response linearity. The inventive sound pickup assembly is suited in general for a wide variety of acoustic string instruments and particularly for acoustic guitars of all kinds. Also, the inventive sound pickup assembly lends itself to mass production in a cost-effective manner.

BRIEF DESCRIPTION OF THE DRAWINGS

The following description of a preferred embodiment of the inventive sound pickup assembly is with reference to the attached drawings wherein.

DETAILED DESCRIPTION OF THE INVENTION

Figure 1:
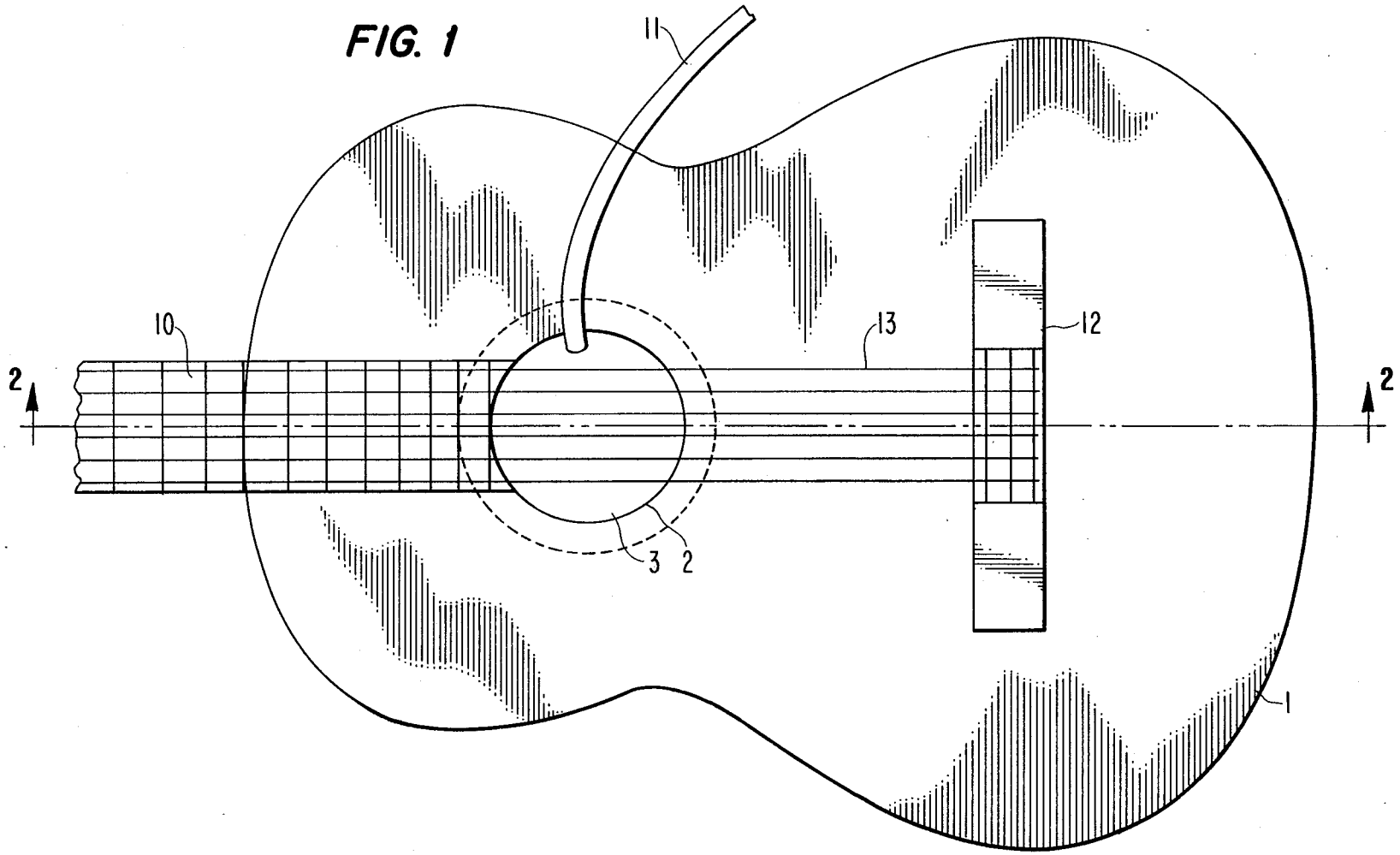
FIG. 1 is a plan view of a guitar having the inventive pick-up assembly installed in the sound hole thereof.
Figure 2:
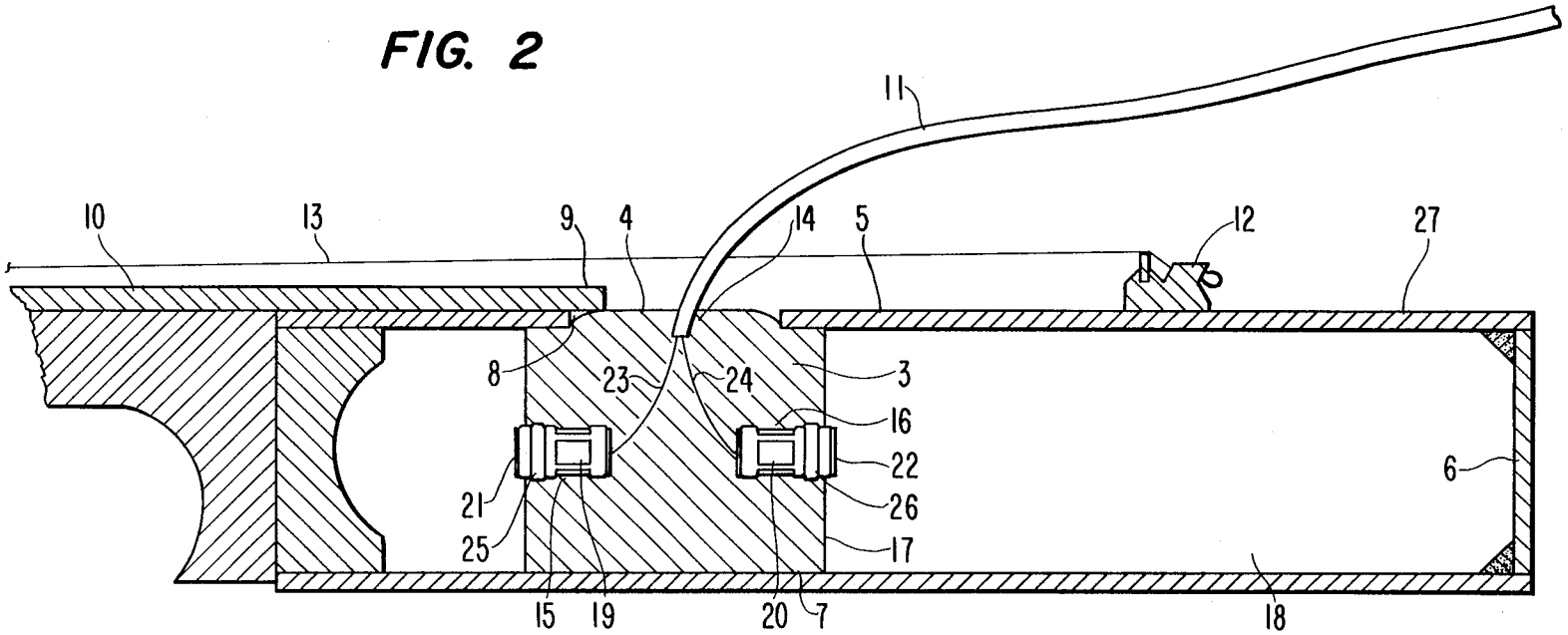
FIG. 2 is a sectional view taken along line 2—2 of FIG. 1.

FIG. 1 shows a plan view of an acoustic guitar 1 having foam pad element 3 fitted and clamped in place in sound hole 2. Attention is directed also to the section view shown in FIG. 2 and taken generally along line 2—2 of FIG. 1. Outwardly directed end face 4 of foam pad element 3, generally cylindrical as seen in FIG. 1, extends substantially flush with the outer surface 5 of resonator body 6 of guitar 1. In this condition, the pad extends through the entire depth of resonator body 6 down to its bottom 7. The inherent resilience of foam pad 3 fitted into sound hole 2 causes foam pad 3 to be seated and retained firmly in an interference fit in position between the edges of the sound hole and bottom 7. In this position, bottom surface 8 of short end section 9 of finger board 10 of guitar 1, which short end section may project a short distance into sound hole 2, additionally secures pad 3 in place against accidental dislocation.

An external lead 11 is run laterally of strings 13 of guitar 1, which strings extend along finger board 10 to bridge 12, into a short guide passage 14 extending axially downwardly, through approximately half the height of the pad, from end face 4 of pad 3 merging into two enlarged openings 15, 16 at opposite sides of the outer peripheral surface 17 of foam pad 3 inside resonator cavity 18 of guitar 1. Openings 15, 16 receive respective microphones 19, 20 in a manner such that the sound waves inside resonator body 6 may without interference strike surface 21, 22, of respective of microphone heads 25, 26. At the lower end of passage 14, lead 11 splits into two separate leads 23, 24 each of which continues to extend through respective enlarged openings 15, 16 to make connection to an respective microphones 19, 20. A disc made of felt material may be placed on surface 4 of foam pad 3 fitted into sound hole 2 to provide a completely planar and flush termination with the top surface 27 of resonator body 6 of guitar 1.

What we claim is:

1. A sound pickup assembly for an acoustic string instrument having a resonator body including an outer surface through which a sound hole extends and a bottom surface spaced from the outer surface, said assembly comprising:

a resilient pad element of foam material adapted to be resiliently seated in the resonator body between the outer surface and the bottom surface and extend into the sound hole thereof, said pad element having an end face and an outer peripheral surface extending from said end face, the end face terminating generally flush with the outer surface of the resonator body and the outer peripheral surface facing the inside of the resonator body with the pad element seated, and guide openings extending therein for receipt of microphones and leads; and microphones extending in the guide openings for picking up sound waves in the resonator body, said microphones having respective heads positioned within the resonator body in a manner in which the sound waves inside the resonator body strike the heads without interference when the pad element is seated within the body.

2. A sound pickup assembly as claimed in claim 1, wherein said foam pad element comprises a material acting to substantially attenuate frequencies at the lower end of the medium frequency range.

3. A sound pickup assembly as claimed in claim 1, wherein said foam pad element is cylindrical in shape, and said guide openings comprise a first guide passage extending axially through approximately half the height of said cylindrical element and merging at an inner end thereof with a second guide passage extending through said cylindrical element diametrically thereof.

4. An acoustic string instrument comprising:

a resonator body including an outer surface through which a sound hole extends and a bottom surface spaced from the outer surface;

a pad element of foam material extending across the sound hole and having an end face terminating generally flush with the outer surface thereat, an outer peripheral surface extending from the end face into the resonator body and guide openings extending therein for receipt of microphones and leads; and microphones extending in the guide openings for picking up sound waves within the resonator body, said microphones having respective heads positioned within the resonator body in a manner in which the sound waves inside the resonator body strike the heads without interference.

* * * * *